US009926510B2

(12) United States Patent
Greaves

(10) Patent No.: US 9,926,510 B2
(45) Date of Patent: Mar. 27, 2018

(54) LUBRICANT COMPOSITION

(71) Applicant: DOW GLOBAL TECHNOLOGIES LLC, Midland, MI (US)

(72) Inventor: Martin R. Greaves, Baer (CH)

(73) Assignee: Dow Global Technologies LLC, Midland, MI (US)

( * ) Notice: Subject to any disclaimer, the term of this patent is extended or adjusted under 35 U.S.C. 154(b) by 91 days.

(21) Appl. No.: 14/434,504

(22) PCT Filed: Oct. 14, 2013

(86) PCT No.: PCT/US2013/064752

§ 371 (c)(1),
(2) Date: Apr. 9, 2015

(87) PCT Pub. No.: WO2014/066076

PCT Pub. Date: May 1, 2014

(65) Prior Publication Data

US 2015/0275124 A1 Oct. 1, 2015

Related U.S. Application Data

(60) Provisional application No. 61/718,283, filed on Oct. 25, 2012.

(51) Int. Cl.

| | |
|---|---|
| ***C07F 5/04*** | (2006.01) |
| ***C10M 107/34*** | (2006.01) |
| ***C10M 145/34*** | (2006.01) |
| ***C10M 169/04*** | (2006.01) |
| ***C10M 107/02*** | (2006.01) |

(52) U.S. Cl.

CPC ..... *C10M 145/34* (2013.01); *C10M 107/02* (2013.01); *C10M 169/041* (2013.01); *C10M 2205/003* (2013.01); *C10M 2205/0285* (2013.01); *C10M 2207/026* (2013.01); *C10M 2207/2825* (2013.01); *C10M 2209/103* (2013.01); *C10M 2209/105* (2013.01); *C10M 2209/106* (2013.01); *C10M 2209/107* (2013.01); *C10M 2215/064* (2013.01); *C10M 2215/065* (2013.01); *C10M 2215/223* (2013.01); *C10M 2223/04* (2013.01); *C10M 2223/043* (2013.01); *C10N 2220/022* (2013.01); *C10N 2230/02* (2013.01); *C10N 2230/06* (2013.01); *C10N 2230/30* (2013.01); *C10N 2230/50* (2013.01); *C10N 2240/04* (2013.01)

(58) Field of Classification Search

CPC ..... C10M 145/26; C10M 145/34; C10M 2209/103

USPC ..... 508/579, 494

See application file for complete search history.

(56) References Cited

U.S. PATENT DOCUMENTS

| | | | | |
|---|---|---|---|---|
| 2007/0004606 | A1* | 1/2007 | da Costa | C10M 107/34 508/579 |
| 2010/0087349 | A1* | 4/2010 | Lee | C10M 111/04 508/499 |
| 2010/0105589 | A1 | 4/2010 | Lee et al. | |
| 2011/0039741 | A1* | 2/2011 | Thoen | C10M 141/06 508/476 |
| 2013/0244917 | A1 | 9/2013 | Obrecht et al. | |
| 2013/0288939 | A1 | 10/2013 | Greaves et al. | |
| 2014/0303053 | A1 | 10/2014 | Greaves | |

FOREIGN PATENT DOCUMENTS

| | | |
|---|---|---|
| JP | S54-159411 | 12/1979 |
| JP | H0-2269198 | 11/1990 |
| JP | 2009161685 | 7/2009 |
| WO | 2011011656 | 1/2011 |

OTHER PUBLICATIONS

EP Response to Office Action dated Oct. 21, 2015; from EP counterpart Application No. 13783764.7.

PCT/US2013/064752 International Search Report and Written Opinion dated Jan. 8, 2014, 8 pages.

PCT/US2013/064752 International Preliminary Report on Patentability dated May 7, 2015, 7 pages.

European Communication pursuant to Rules 161(1) and 162 EPC for counterpart European Application No. 13783764.7, 2 pages.

Zhong, et al., "Lubricating Greases and Additives for Automobiles"; Chemical Industry Press, p. 19 (1 pg) (Jul. 31, 2006) (English Machine Translation).

* cited by examiner

*Primary Examiner* — Prem C Singh
*Assistant Examiner* — Frank C Campanell
(74) *Attorney, Agent, or Firm* — Brooks, Cameron & Huebsch, PLLC

(57) ABSTRACT

A lubricant composition comprising from 75 to 95 percent by weight polyalphaolefin base oil; and from 7.5 to 25 percent by weight oil soluble polyalkylene glycol (OSP) additive, wherein the polyalkylene glycol has a viscosity at 40° C. from 15 cSt to 50 cSt and comprises units derived from propylene oxide and units derived from butylene oxide; wherein the lubricant composition exhibits a four ball EP weld load result of at least 160 kg and an air release value at 75° C. of less than 3 minutes is provided.

10 Claims, No Drawings

LUBRICANT COMPOSITION

FIELD OF INVENTION

The instant invention relates to a lubricant composition.

BACKGROUND

Two important performance properties of gear oils are their extreme pressure performance and their air release properties. Formulated gear fluids which combine very low air release values and high extreme pressure values are highly desired.

One trend in the industry is the design of gear boxes by OEMs with smaller reservoirs and therefore smaller lubricant volumes per gear box are needed. During gear operation this puts extra stress on the gear lubricant as temperatures increase since there is less fluid available to dissipate the heat. In addition gear lubricants can entrain air and it is important that this air is released rapidly. It is common for lubricants to entrain 10% by volume of air. Entrained air can cause poor friction control, enhanced oxidation, noise, vibration and cavitation. For these reasons, fluids with lower air release values are desired. Furthermore it is important that gear lubricants have excellent extreme pressure properties to prevent welding under high contact pressures as the gear teeth mesh.

Most commercially available industrial gear lubricants are in the viscosity range ISO-150 to 1000 (i.e. 150 to 1000 cSt at 40° C.). Their air release values are >5 minutes and typically in the range 10-20 minutes at 75° C.

SUMMARY

In one embodiment, the instant invention provides a lubricant composition comprising from 75 to 95 percent by weight polyalphaolefin base oil; and from 7.5 to 25 percent by weight oil soluble polyalkylene glycol (OSP) additive, wherein the polyalkylene glycol has a viscosity at 40° C. from 15 cSt to 50 cSt and comprises units derived from propylene oxide and units derived from butylene oxide; wherein the lubricant composition exhibits a four ball EP weld load result of at least 160 kg and an air release value at 75° C. of less than 3 minutes.

DETAILED DESCRIPTION

It has been discovered that gear lubricants formulated with polyalphaolefins (PAOs) that contain certain oil soluble polyalkylene glycol (OSP) at levels from 7.5 to 20 percent by weight as an additive can also have low air release values and also have good extreme pressure properties.

The lubricant composition comprises from 75 to 95 percent by weight polyalphaolefin base oil; and from 7.5 to 25 percent by weight oil soluble polyalkylene glycol (OSP) additive, wherein the OSP has a kinematic viscosity at 40° C. from 15 cSt to 50 cSt and comprises units derived from propylene oxide and units derived from butylene oxide; wherein the lubricant composition exhibits a four ball EP weld load result of at least 160 kg and an air release value at 75° C. of less than 3 minutes.

All individual values and subranges from 75 to 92.5 percent by weight PAO are included herein and disclosed herein; for example, the PAO can range from a lower limit of 75, 78, 81, 85, 91 or 92 percent by weight to an upper limit of 76, 80, 84, 88, or 92.5 percent by weight. For example, the amount of PAO in the lubricant composition may be from 75 to 92.5 percent by weight, or in the alternative, the amount of PAO in the lubricant composition may be from 80 to 90 percent by weight, or in the alternative, the amount of PAO in the lubricant composition may be from 85 to 92.5 percent by weight.

Any polyalphaolefin base oil, as are well known in the art, may be used. Exemplary commercial polyalphaolefin base oils include those available under the tradenames: SPECTRASYN, from ExxonMobil Chemical Company, SYNFLUID from Chevron Phillips and SYNTON from Chemtura.

All individual values and subranges from 7.5 to 25 percent by weight OSP in the lubricant composition are included herein and disclosed herein; for example, the OSP can range from a lower limit of 7.5, 10, 12.5, 15, 17.5, 20, 22.5 or 24 percent by weight to an upper limit of 8, 11, 13, 16, 18.5, 21, 23.5 or 25 percent by weight. For example, the amount of OSP in the lubricant composition may be from 7.5 to 25 percent by weight, or in the alternative, the amount of OSP in the lubricant composition may be from 10 to 20 percent by weight, or in the alternative, the amount of OSP in the lubricant composition may be from 15 to 20 percent by weight.

The OSP has a kinematic viscosity at 40° C. from 15 cSt to 50 cSt. All individual values and subranges from 15 to 50 cSt are included herein and disclosed herein; for example, the kinematic viscosity can be from a lower limit of 15, 20, 25, 30, 35, 40 or 45 cSt to an upper limit of 17.5, 22.5, 27.5, 32.5, 37.5, 42.5, 47.5 or 50 cSt. For example, the viscosity of the OSP can be in a range of from 15 to 50 cSt, or in the alternative, the viscosity of the OSP can be in a range of from 25 to 50 cSt, or in the alternative, the viscosity of the OSP can be in a range of from 25 to 45 cSt, or in the alternative, the viscosity of the OSP can be in a range of from 15 to 35 cSt, or in the alternative, the viscosity of the OSP can be in a range of from 18 to 46 cSt.

The lubricant composition exhibits a four ball EP weld load of at least 160 kg. All individual values and subranges of at least 160 kg are included herein and disclosed herein; for example, the four ball EP weld load may be from a lower limit of 160, 170, 180, 190 or 200 kg.

The lubricant composition exhibits an air release value at 75° C. of less than 3 minutes. All individual values and subranges of less than 3 minutes are included herein and disclosed herein; for example, the air release value at 75° C. may be from an upper limit of 3, 2.5, 2, 1.5 or 1 minutes.

In an alternative embodiment, the OSP has a molecular weight from 400 to 1100 g/mole. All individual values and subranges are disclosed herein and included herein; for example the molecular weight of the OSP can range from a lower limit of 400, 500, 600, 700, 800, 900, or 1000 g/mole to an upper limit of 450, 550, 650, 750, 850, 950, 1050 or 1100 g/mole. For example, the molecular weight of the OSP may range from 400 to 1100 g/mole, or in the alternative, the molecular weight of the OSP may range from 500 to 1000 g/mole, or in the alternative, the molecular weight of the OSP may range from 400 to 800 g/mole, or in the alternative, the molecular weight of the OSP may range from 600 to 1000 g/mole.

In an alternative embodiment, the instant invention provides a lubricant composition, in accordance with any of the preceding embodiments, except that the OSP comprises from 30 to 70 percent by weight units derived from propylene oxide and from 70 to 30 percent by weight units derived from butylene oxide. All individual values and subranges from 30 to 70 percent by weight units derived from propylene oxide are included herein and disclosed herein; for example, the amount of units derived from propylene oxide may range from a lower limit of 30, 40, 50, or 60 percent by weight to an upper limit of 35, 45, 55, 65, or 70 percent by weight. For example, the amount of units derived from propylene oxide may range from 30 to 70 percent by weight, or in the alternative, the amount of units derived from propylene oxide may range from 40 to 60 percent by weight, or in the alternative, the amount of units derived from propylene oxide may range from 40 to 70 percent by weight, or in the alternative, the amount of units derived from propylene oxide may range from 45 to 55 percent by weight, or in the alternative, the amount of units derived from propylene oxide may be 50 percent by weight. All individual values and subranges from 30 to 70 percent by weight units derived from butylene oxide are included herein and disclosed herein; for example, the amount of units derived from butylene oxide may range from a lower limit of 30, 40, 50, or 60 percent by weight to an upper limit of 35, 45, 55, 65, or 70 percent by weight. For example, the amount of units derived from butylene oxide may range from 30 to 70 percent by weight, or in the alternative, the amount of units derived from butylene oxide may range from 40 to 60 percent by weight, or in the alternative, the amount of units derived from butylene oxide may range from 30 to 60 percent by weight, or in the alternative, the amount of units derived from butylene oxide may range from 45 to 55 percent by weight, or in the alternative, the amount of units derived from butylene oxide may be 50 percent by weight.

In an alternative embodiment, the instant invention provides a lubricant composition, in accordance with any of the preceding embodiments, except that the OSP has a viscosity of 32 cSt.

OSPs useful in embodiments of the lubricant composition are initiated by one or more initiators selected from group consisting of alcohols (i.e., monols), diols, and polyols. Exemplary alcohol (i.e., monol) initiators include methanol, ethanol, propanol, butanol, pentanol, hexanol, neopentanol, isobutanol, decanol, 2-ethylhexanol, and the like, as well as higher acyclic alcohols derived from both natural and petrochemical sources with from 11 carbon atoms to 22 carbon atoms alcohols Exemplary diol initiators include monoethylene glycol, monopropylene glycol, butylene glycol, diethylene glycol or dipropylene glycol. Exemplary polyol initiators include neopentyl glycol, trimethyolpropane and pentaerythritiol.

In an alternative embodiment, the invention provides a lubricant composition further comprising at least 0.05 wt % of at least one extreme pressure additive. All individual values and subranges from at least 0.05 weight percent anti-wear additive are included herein and disclosed herein; for example, the amount of anti-wear additive in the lubricant composition can be from a lower limit of 0.05, 0.15, 0.25, 0.5, 0.8 or 1 weight percent Exemplary extreme pressure additives include ashless dithiophosphates, triaryl phosphothionates, alkyl diphenylphosphites, amine phosphates, dithiophosphates and triaryl phosphothionates. Examples of yellow metal passivators include tolyltriazole, benzotriazole and N-alkylated toyltriazole. Examples of antioxidants include octylated diphenylamine, alkylated phenyl alpha napthylamine, octylated/butylated diphenylamine and phenolic types antioxidant.

Some embodiments of the lubricant composition may further comprise one or more additives selected from the group consisting of anti-wear additives, yellow metal passivators, and anti-oxidants. Exemplary anti-wear additives include zinc dialkyldithiophosphates, amine phosphates, dithiocarbamates, alkylphosphate esters, ashless dithiocarbamates, combinations thereof and blends thereof.

Examples of yellow metal passivators include tolyltriazole, benzotriazole and N-alkylated toyltriazole. Examples of antioxidants include octylated diphenylamine, alkylated phenyl alpha napthylamine, octylated/butylated diphenylamine and phenolic types antioxidant.

In an alternative embodiment, the instant invention provides a lubricant composition, in accordance with any of the preceding embodiments, except that the lubricant composition further comprises from 0.25 to 2 percent by weight of one or more extreme pressure additives. All values and subranges from 0.25 to 2 percent by weight are included herein and disclosed herein; for example, the amount of extreme pressure additive can range from a lower limit of 0.25, 0.5, 0.75, 1, 1.25, 1.5, or 1.75 percent by weight to an upper limit of 0.5, 0.75, 1, 1.25, 1.5, 1.75, or 2 percent by weight. For example, the amount of one or more extreme pressure additives may be from 0.25 to 2 percent by weight, or in the alternative, the amount of one or more extreme pressure additives may be from 0.25 to 1 percent by weight, or in the alternative, the amount of one or more extreme pressure additives may be from 1 to 2 percent by weight, or in the alternative, the amount of one or more extreme pressure additives may be from 0.75 to 1.75 percent by weight, or in the alternative, the amount of one or more extreme pressure additives may be from 0.5 to 1 percent by weight.

The lubricant composition according to any of the embodiments disclosed herein may be used as or in a gear oil, hydraulic fluid, compressor oil and/or engine oil.

In an alternative embodiment, the invention provides a lubricant composition consisting essentially of from 75 to 95 percent by weight polyalphaolefin base oil; and from 7.5 to 25 percent by weight oil soluble polyalkylene glycol (OSP) additive, wherein the polyalkylene glycol has a viscosity at 40° C. from 15 cSt to 50 cSt and comprises units derived from propylene oxide and units derived from butylene oxide; wherein the lubricant composition exhibits a four ball EP weld load result of at least 160 kg and an air release value at 75° C. of less than 3 minutes.is provided.

In another alternative embodiment, the invention provides a lubricant composition comprising from 75 to 95 percent by weight polyalphaolefin base oil; and from 7.5 to 25 percent by weight oil soluble polyalkylene glycol (OSP) additive, wherein the polyalkylene glycol has a viscosity at 40° C. from 15 cSt to 50 cSt and consists essentially of units derived from propylene oxide and units derived from butylene oxide; wherein the lubricant composition exhibits a four ball EP weld load result of at least 160 kg and an air release value at 75° C. of less than 3 minutes.is provided.

In yet another alternative embodiment, the invention provides a lubricant composition consisting essentially of from 75 to 95 percent by weight polyalphaolefin base oil; and from 7.5 to 25 percent by weight oil soluble polyalkylene glycol (OSP) additive, wherein the polyalkylene glycol has a viscosity at 40° C. from 15 cSt to 50 cSt and consists essentially of units derived from propylene oxide and units derived from butylene oxide; wherein the lubricant composition exhibits a four ball EP weld load result of at least 160 kg and an air release value at 75° C. of less than 3 minutes.is provided.

EXAMPLES

The following examples illustrate the present invention but are not intended to limit the scope of the invention. Table 1 provides a listing of polyalphaolefin base oils, OSP additives, anti-wear additives, antioxidants, extreme pressure additives and yellow metal passivators, their compositions, properties and commercial suppliers, used in the inventive and comparative examples.

TABLE 1

| Component | Commercial Supplier | Composition/Properties |
|---|---|---|
| UCON OSP-32 | The Dow Chemical Company | Alcohol initiated random copolymer (PO/BO) with a typical kinematic viscosity at 40° C. of 32 $mm^2/s$ (cSt) and an average molecular weight of 760 g/mole |
| UCON OSP-68 | The Dow Chemical Company | Alcohol initiated random copolymer (PO/BO) with a typical kinematic viscosity at 40° C. of 68 $mm^2/s$ (cSt) and an average molecular weight of 1400 g/mole |
| UCON OSP-320 | The Dow Chemical Company | Butylene oxide homopolymer with a typical kinematic viscosity at 40° C. of 320 $mm^2/s$ (cSt) and an average molecular weight of 2700 g/mole |
| UCON OSP-680 | The Dow Chemical Company | Butylene oxide homopolymer with a typical kinematic viscosity at 40° C. of 680 $mm^2/s$ (cSt) and an average molecular weight of 5100 g/mole |
| SYNALOX OA-25 | The Dow Chemical Company | Alcohol initiated butylene oxide homopolymer with a typical kinematic viscosity at 40° C. of 25 $mm^2/s$ (cSt) and an average molecular weight of 750 g/mole |
| SPECTRASYN 8 | ExxonMobil Chemical Company | A polyalphaolefin based oil with a typical kinematic viscosity at 100° C. of 8 CSt. |
| SPECTRASYN 40 | ExxonMobil Chemical Company | A polyalphaolefin based oil with a typical kinematic viscosity at 100° C. of 40 CSt. |
| SYNATIV DITA | BASF | A synthetic ester (di-isotridecyl adipate) with a typical kinematic viscosity at 40° C. of 25 cSt. |
| ANTIWEAR ADDITIVES | | |
| NA-SUL ® AW 6110 | King Industries | Amine salts of aliphatic phosphoric acid esters, typical kinematic viscosity at 40° C. of 448 $mm^2/s$ (cSt), nitrogen content = 1.8% and phosphorus content = 8.2% |
| ANTIOXIDANTS | | |
| IRGANOX L06 | BASF | N-phenyl-ar-(1,1,3,3-tetramethylbutyl)-1-naphthalenamine |
| IRGANOX L57 | BASF | The benzeneamine and N-phenyl-reaction products with 2,4,4-trimethylpentene diphenylamine |
| IRGANOX L135 | BASF | a high molecular weight phenolic antioxidant |
| VANLUBE 81 | RT Vanderbilt Company | An aromatic based aminic antioxidant. |
| EXTREME PRESSURE ADDITIVE | | |
| DURAD 310M | Chemtura Corporation | a mixed organophosphate ester having a viscosity at 40° C. of 51 cSt |
| YELLOW METAL PASSIVATOR | | |
| TOLYTRIAZOLE | BASF | 5-methyl benzotriazole |

The compositions and selected properties of Inventive Examples 1-2 are shown in Table 2. The compositions and selected properties of Comparative Examples 1-5 are shown in Table 3. The compositions and selected properties of Comparative Examples 6-9 are shown in Table 4. As used herein "wt %" and "percent by weight" are synonymous.

TABLE 2

| | Inv. Ex. 1 wt % | Inv. Ex. 2 wt % |
|---|---|---|
| Component | | |
| Spectrasyn 8 | 15.35 | 15.35 |
| Spectrasyn 40 | 72 | 62 |
| UCON OSP-32 | 10 | 20 |
| Irganox L135 | 0.75 | 0.75 |
| Vanlube 81 | 1 | 1 |
| Durad 310M | 0.75 | 0.75 |
| NaLube AW6110 | 0.15 | 0.15 |
| Property | | |
| Kinematic Viscosity 40° C., cst | 190.5 | 136 |
| Kinematic Viscosity 100° C., cSt | 22.8 | 18.1 |
| Viscosity index | 146 | 149 |
| Density 40° C., g/cc | 0.844 | 0.882 |
| Appearance at ambient temperature | clear | Clear |
| Air release 75° C., mins, ASTM D3427 | 2 | 2.8 |
| Welding Load 1760 ± 40 rpm, kg, ASTM 2793 | 160 | 200 |

TABLE 4-continued

| | Comp. Ex. 6 wt % | Comp. Ex. 7 wt % | Comp. Ex. 8 wt % | Comp. Ex. 9 wt % |
|---|---|---|---|---|
| UCON OSP-680 | | | 82 | 72.35 |
| Synativ DITA | 10 | 5 | | |
| Irganox L135 | 0.75 | 0.75 | 0.75 | 0.75 |
| Vanlube 81 | 1 | 1 | 1 | 1 |
| Durad 310M | 0.75 | 0.75 | 0.75 | 0.75 |
| NaLube AW6110 | 0.15 | 0.15 | 0.15 | 0.15 |
| Properties | | | | |
| Kinematic Viscosity 40° C., cst | 188.1 | 217.7 | 404.3 | 312.2 |
| Kinematic Viscosity 100° C., cSt | 22.5 | 25.3 | 48.2 | 39.5 |
| Viscosity index | 145 | 147 | 180 | 179. |
| Density 40° C., g/ml | 0.842 | 0.839 | 0.935 | 0.919 |
| Appearance at ambient temperature | clear | Clear | clear | Clear |
| Air release 75° C., mins, ASTM D3427 | 3.1 | 4.1 | 6.1 | 7 |
| Welding Load 1760 ± 40 rpm, kg, ASTM 2793 | 160 | 200 | 160 | 200 |

As can be seen by the foregoing, lubricant compositions having a polyalphaolefin base oil and an OSP additive according to the foregoing embodiments of the inventive composition exhibit excellent air release and extreme pressure properties.

TABLE 3

| | Comp. Ex. 1 wt % | Comp. Ex. 2 wt % | Comp. Ex. 3 wt % | Comp. Ex. 4 wt % | Comp. Ex. 5 wt % |
|---|---|---|---|---|---|
| Component | | | | | |
| Spectrasyn 8 | 15.35 | 15.35 | 15.35 | 15.35 | 15.35 |
| Spectrasyn 40 | 72 | 72 | 77 | 82 | 72 |
| UCON OSP-320 | | 10 | | | |
| UCON OSP-32 | | | 5 | | |
| UCON OSP-68 | 10 | | | | |
| SYNALOX OA-25 | | | | | 10 |
| Irganox L135 | 0.75 | 0.75 | 0.75 | 0.75 | 0.75 |
| Vanlube 81 | 1 | 1 | 1 | 1 | 1 |
| Durad 310M | 0.75 | 0.75 | 0.75 | 0.75 | 0.75 |
| NaLube AW6110 | 0.15 | 0.15 | 0.15 | 0.15 | 0.15 |
| Property | | | | | |
| Kinematic Viscosity 40° C., cst | | | 219 | 256.5 | 182.9 |
| Kinematic Viscosity 100° C., cSt | | | 25.2 | 28.2 | 22.1 |
| Viscosity index | | | 145 | 145 | 145 |
| Density 40° C., g/ml | | | 0.841 | 0.837 | 0.845 |
| Appearance at ambient temperature | turbid | turbid and 2-phase | clear | clear | clear |
| Air release 75° C., mins, ASTM D3427 | n/d | n/d | 8.3 | 5.4 | 5.2 |
| Welding Load 1760 ± 40 rpm, kg, ASTM D2793 | n/d | n/d | 200 | 200 | 160 |

TABLE 4

| | Comp. Ex. 6 wt % | Comp. Ex. 7 wt % | Comp. Ex. 8 wt % | Comp. Ex. 9 wt % |
|---|---|---|---|---|
| Component | | | | |
| Spectrasyn 8 | 15.35 | 15.35 | 15.35 | 25 |
| Spectrasyn 40 | 72 | 77 | | |

Test Methods

Test methods include the following:

Kinematic viscosities at 40° C. and at 100° C. were measured in accordance with ASTM

D445.

Viscosity index was measured in accordance with ASTM 2270.

Density was measured in accordance with ASTM D7042.

Air release was measured in accordance with ASTM D3427. For hydraulic fluids which are typically low viscosity fluids and in the range 22 to 150 cSt at 40° C., air release measurements were made at 50° C. For higher viscosity fluids measurements were made at higher temperatures such as 75° C.

Extreme pressure welding load was measured at 1760+/−40 rpm, a temperature of 18-36° C., in accordance with ASTM D2793.

Unless otherwise stated, implicit from the context or conventional in the art, all parts and percentages are based on weight. All applications, publications, patents, test procedures, and other documents cited, including priority documents, are fully incorporated by reference to the extent such disclosure is not inconsistent with the disclosed compositions and methods and for all jurisdictions in which such incorporation is permitted.

The present invention may be embodied in other forms without departing from the spirit and the essential attributes thereof, and, accordingly, reference should be made to the appended claims, rather than to the foregoing specification, as indicating the scope of the invention.

I claim:

1. A lubricant composition comprising from 75 to 95 percent by weight polyalphaolefin base oil; and from 7.5 to 25 percent by weight oil soluble polyalkylene glycol (OSP) additive, wherein the polyalkylene glycol has a viscosity at 40° C. from 15 cSt to 50 cSt and comprises units derived from propylene oxide and units derived from butylene oxide, and the OSP additive has a molecular weight from 400 to 1100 g/mole;

wherein the lubricant composition exhibits a four ball EP weld load result of at least 160 kg and an air release value at 75° C. of less than 3 minutes.

2. The lubricant composition according to claim 1, wherein the OSP additive comprises from 30 to 70 percent by weight units derived from propylene oxide and from 70 to 30 percent by weight units derived from butylene oxide.

3. The lubricant composition according to claim 1, wherein the OSP additive comprises from 40 to 60 percent by weight units derived from propylene oxide and from 60 to 40 percent by weight units derived from butylene oxide.

4. The lubricant composition according to claim 1, wherein the OSP additive comprises 50 percent by weight units derived from propylene oxide and 50 percent by weight units derived from butylene oxide.

5. The lubricant composition according to claim 1, wherein the OSP additive has a viscosity from 18 to 46 cSt.

6. The lubricant composition according to claim 1, wherein the OSP additive has a viscosity of 32 cSt.

7. The lubricant composition according to claim 1, further comprising one or more additives selected from the group consisting of anti-wear additives, yellow metal passivators, and anti-oxidants.

8. The lubricant composition according to claim 1, further comprising from 0.25 to 2 percent by weight of one or more extreme pressure additives.

9. The lubricant composition according to claim 1, further comprising from 0.5 to 1 percent by weight of one or more extreme pressure additives.

10. A gear lubricant comprising the lubricant composition of claim 1.

* * * * *